US008061666B1

(12) United States Patent
Fortin et al.

(10) Patent No.: US 8,061,666 B1
(45) Date of Patent: Nov. 22, 2011

(54) ADAPTER ASSEMBLY FOR POLE LUMINAIRE

(75) Inventors: Michel Fortin, Ste-Marthe-sue-le-lac (CA); Guy Galipeau, Ste. Therese (CA)

(73) Assignee: Philips Electronics Ltd, Markham, Ontario (CA)

( * ) Notice: Subject to any disclaimer, the term of this patent is extended or adjusted under 35 U.S.C. 154(b) by 408 days.

(21) Appl. No.: 12/185,971

(22) Filed: Aug. 5, 2008

(51) Int. Cl.
*A47B 96/06* (2006.01)

(52) U.S. Cl. ..... 248/219.1; 248/219.2

(58) Field of Classification Search ..... 248/218.4, 248/219.1, 219.2, 219.4
See application file for complete search history.

(56) References Cited

U.S. PATENT DOCUMENTS

| | | | | |
|---|---|---|---|---|
| 114,513 | A | 5/1871 | Aronson | |
| 187,423 | A | 2/1877 | Shirley | |
| 194,402 | A | 8/1877 | Barns | |
| 357,217 | A | 2/1887 | McCallip | |
| 680,342 | A | 8/1901 | Martin | |
| 708,087 | A | 9/1902 | Smith | |
| 1,045,852 | A | 12/1912 | Jones | |
| 1,086,346 | A | 2/1914 | Barrick | |
| 1,095,197 | A | 5/1914 | Entenmann | |
| 1,201,108 | A | 10/1916 | Smith | |
| 1,261,213 | A * | 4/1918 | Clay | 403/233 |
| 1,388,221 | A | 8/1921 | Toepfer | |
| 1,456,314 | A | 5/1923 | Key | |
| 1,481,187 | A | 1/1924 | Clay | |
| 1,539,131 | A | 5/1925 | McCarley | |
| 1,633,837 | A | 6/1927 | Youtz | |
| 1,776,682 | A | 9/1930 | King | |
| 1,903,907 | A | 4/1933 | Riemenschneider | |
| 1,906,508 | A | 5/1933 | Arbogast | |
| 2,166,394 | A | 7/1939 | Crossley | |
| 2,209,580 | A | 7/1940 | Sargent | |
| 2,232,625 | A | 2/1941 | O'Keeffe | |
| 2,288,166 | A | 6/1942 | Kucher | |
| 2,313,131 | A | 3/1943 | Elias | |
| 2,318,296 | A | 5/1943 | Hoyt | |
| 2,545,163 | A | 3/1951 | Naster | |
| 2,593,171 | A | 4/1952 | Morse | |
| 2,687,867 | A | 8/1954 | Wolar | |
| 2,782,295 | A | 2/1957 | Schwenkler | |
| 2,791,241 | A | 5/1957 | Reed | |
| 2,836,709 | A | 5/1958 | Dusen | |
| 2,852,663 | A | 9/1958 | Stuffer et al. | |
| 2,960,361 | A | 11/1960 | Boutelle | |
| 2,971,737 | A | 2/1961 | Parker | |
| 2,973,895 | A | 3/1961 | Brown et al. | |
| 3,078,366 | A | 2/1963 | Winkler | |
| 3,082,987 | A | 3/1963 | Robinson | |
| 3,083,796 | A | 4/1963 | Bell, Jr. | |
| 3,094,238 | A | 6/1963 | Davidson | |

(Continued)

*Primary Examiner* — Terrell McKinnon
*Assistant Examiner* — Erin W Smith
(74) *Attorney, Agent, or Firm* — John F. Salazar

(57) ABSTRACT

A pole adapter assembly for a pole luminaire includes an adapter body having an upper end, a lower end and an aperture for receiving a pole at the lower end, one of a raised area or a recessed area located on the body between the upper end and the lower end, a multi-point contact area along one plane of the body beneath the one of a raised area or recessed area having a first rib opposite a first set fastener, a second rib opposite a second set fastener and spaced from the first rib and the first set fastener, and at least one fastener and opposed nut disposed between the first and second ribs and the first and second set fasteners.

2 Claims, 13 Drawing Sheets

U.S. PATENT DOCUMENTS 3,096,029 A 7/1963 Berge
3,154,704 A 10/1964 Shaffer
3,158,349 A 11/1964 Bergstrom
3,193,059 A 7/1965 Wallerstein
3,194,427 A 7/1965 Mullet et al.
3,222,509 A 12/1965 Thedford
3,278,743 A 10/1966 Franck
3,299,200 A 1/1967 Sulzer
3,299,265 A 1/1967 Rackley et al.
3,319,203 A 5/1967 Haughney
3,325,950 A 6/1967 Pfaff
3,328,579 A 6/1967 Green
3,335,534 A 8/1967 Hester et al.
3,343,322 A 9/1967 Lurkis et al.
3,362,737 A 1/1968 Cobb
3,369,331 A 2/1968 Deskey et al.
3,385,656 A 5/1968 Aven
3,388,246 A 6/1968 Bailey
3,400,905 A 9/1968 Van Dusen
3,403,520 A 10/1968 Goodman
3,410,995 A 11/1968 Gray
3,429,758 A 2/1969 Young
3,433,449 A 3/1969 Musante
3,479,081 A 11/1969 Schaaf
3,481,369 A 12/1969 Ganahl
3,505,515 A 4/1970 Adra
3,541,478 A 11/1970 Peterson et al.
3,563,502 A 2/1971 Dayson
3,603,717 A 9/1971 Scott
3,604,916 A 9/1971 Adra
3,655,468 A 4/1972 Bastone et al.
3,671,738 A 6/1972 Beachley
3,754,724 A 8/1973 Osowski
3,778,610 A 12/1973 Wolf
3,803,400 A 4/1974 Ozawa
3,813,837 A 6/1974 McClain et al.
3,833,804 A 9/1974 Vesely
3,852,588 A 12/1974 Crawford
3,853,418 A 12/1974 Druin et al.
3,866,034 A 2/1975 Russo
3,869,858 A 3/1975 Goto et al.
3,886,024 A 5/1975 Chase
3,886,029 A 5/1975 Poulsen
3,974,372 A 8/1976 Cochran
3,991,905 A 11/1976 Nicpon
4,000,406 A 12/1976 Bhavsar
4,028,542 A 6/1977 McReynolds, Jr.
4,048,360 A 9/1977 Jonda
4,070,567 A 1/1978 Crompton
4,089,727 A 5/1978 McLain
4,090,210 A 5/1978 Wehling et al.
4,091,444 A 5/1978 Mori
4,112,483 A 9/1978 Small, Jr. et al.
4,142,227 A 2/1979 Aikens
4,143,413 A 3/1979 Kelly
4,166,537 A 9/1979 Fortunato
4,173,037 A 10/1979 Henderson, Jr. et al.
4,200,906 A 4/1980 Santilli
4,201,823 A 5/1980 Russell
4,212,050 A 7/1980 Trenkler
4,246,732 A 1/1981 Frehner
4,254,456 A 3/1981 Grindle et al.
4,262,047 A 4/1981 Barnett et al.
4,269,010 A 5/1981 Glass
4,310,876 A 1/1982 Small, Jr. et al.
4,319,312 A 3/1982 De Vos et al.
4,319,313 A 3/1982 Eberhart et al.
4,333,131 A 6/1982 Hujimoto et al.
4,336,868 A 6/1982 Wilson et al.
4,337,507 A 6/1982 Lasker
4,343,567 A 8/1982 Sarver et al.
4,381,960 A 5/1983 Pinter et al.
4,388,787 A 6/1983 Milbright
4,395,750 A 7/1983 Scheidemann et al.
4,403,278 A 9/1983 Flood
4,414,616 A 11/1983 De Vos et al.
4,422,135 A 12/1983 McCamy
4,445,163 A 4/1984 Ziaylek, Jr.
4,449,168 A 5/1984 Ewing
4,459,648 A 7/1984 Ullman
4,460,948 A 7/1984 Malola
4,462,068 A 7/1984 Shadwick
4,471,411 A 9/1984 Graham et al.
4,473,873 A 9/1984 Quiogue
4,488,696 A 12/1984 Sauber
4,523,263 A 6/1985 Poyer
4,527,224 A 7/1985 Sangiamo et al.
4,548,377 A 10/1985 Huel
4,564,890 A 1/1986 Poyer
4,590,544 A 5/1986 Decandia
4,617,768 A 10/1986 Gebelius
4,621,662 A 11/1986 Olry
4,622,086 A 11/1986 Puck et al.
4,623,956 A 11/1986 Conti
4,658,335 A 4/1987 Culler
4,701,577 A 10/1987 Bourrieres
4,705,425 A 11/1987 Okawa
4,709,890 A 12/1987 Moore
4,760,511 A 7/1988 Russello et al.
4,784,351 A 11/1988 Eickmann
4,794,501 A 12/1988 Bartenbach
4,803,819 A 2/1989 Kelsey
4,842,238 A * 6/1989 Toiyama ..... 248/562
4,858,877 A 8/1989 Carter
4,893,224 A 1/1990 Tinley
4,920,715 A 5/1990 Parsons et al.
4,921,557 A 5/1990 Nakamura
4,947,307 A 8/1990 Quioque
4,951,182 A 8/1990 Simonson et al.
4,969,074 A 11/1990 Davis et al.
4,970,634 A 11/1990 Howell et al.
4,972,601 A 11/1990 Bickford et al.
5,016,150 A 5/1991 Gordin et al.
5,028,464 A 7/1991 Shigetoh
5,040,917 A 8/1991 Camuffo
5,055,987 A 10/1991 Ellson et al.
5,060,437 A 10/1991 Parsons et al.
5,062,029 A 10/1991 Engel
5,068,769 A 11/1991 Umeda et al.
5,081,569 A 1/1992 Quioque et al.
5,086,379 A 2/1992 Denison et al.
5,099,405 A 3/1992 Gehly et al.
5,111,371 A 5/1992 Nielson
5,183,330 A 2/1993 Rishel et al.
5,197,819 A 3/1993 Hughes
5,220,744 A 6/1993 Kendall
5,228,260 A 7/1993 Dziedzic
5,249,110 A 9/1993 Russello et al.
5,274,537 A 12/1993 Altman
5,289,358 A 2/1994 Halemeier
5,307,254 A 4/1994 Russello et al.
5,323,995 A 6/1994 Grittman
D348,745 S 7/1994 Ewing et al.
5,339,224 A 8/1994 Russello et al.
5,398,180 A 3/1995 Lee
5,433,333 A 7/1995 Martell
5,442,132 A 8/1995 Sandell et al.
5,492,576 A 2/1996 Jehl et al.
5,499,885 A 3/1996 Chapman
5,504,397 A 4/1996 Chien
5,505,036 A 4/1996 Wiles
5,513,477 A 5/1996 Farber
5,572,846 A 11/1996 Sosa
5,613,766 A 3/1997 Raouf
5,625,988 A 5/1997 Killick
5,642,934 A 7/1997 Haddad
5,647,659 A 7/1997 Mori
5,667,188 A * 9/1997 Bettinsoli ..... 248/558
5,690,419 A 11/1997 Siems
5,701,236 A 12/1997 Viviano
5,704,187 A 1/1998 Hosford et al.
5,704,580 A 1/1998 Perry, Jr.
5,704,710 A 1/1998 Greene et al.
D390,994 S 2/1998 Ewing et al.
D390,995 S 2/1998 Ewing et al.
D391,383 S 2/1998 Ewing et al.
5,722,770 A 3/1998 Douglas 5,761,875 A 6/1998 Oliphant et al.
5,775,035 A 7/1998 Papin
5,803,585 A 9/1998 Littman et al.
D400,277 S 10/1998 Ewing et al.
5,833,351 A 11/1998 Marsh
5,870,877 A 2/1999 Turner
5,887,856 A 3/1999 Everly, II
5,906,431 A 5/1999 Chianale et al.
5,918,849 A 7/1999 Bliss
5,941,485 A 8/1999 Davidson et al.
5,954,426 A 9/1999 Whittington
6,027,228 A 2/2000 Adams et al.
6,033,089 A 3/2000 Tesauro
6,059,424 A 5/2000 Kotloff
6,116,564 A 9/2000 Cates
6,152,579 A 11/2000 Reed et al.
6,155,017 A 12/2000 Turner
6,164,803 A 12/2000 Reniger et al.
6,167,673 B1 1/2001 Fournier
6,240,689 B1 6/2001 Haddad et al.
6,290,376 B1 9/2001 Gutierrez et al.
6,322,863 B1 11/2001 Kubicky
6,327,833 B1 12/2001 Miskelley et al.
6,363,644 B1 4/2002 Frost
6,375,141 B1 4/2002 Kettlestrings
6,389,760 B1 5/2002 McDonnell
6,517,216 B1 2/2003 Cercone et al.
6,530,681 B2 3/2003 Sieczkowski
6,585,398 B1 7/2003 Haddad
6,607,292 B2 8/2003 Gutierrez et al.
6,733,158 B2 5/2004 Fischer et al.
6,848,806 B2 2/2005 Yoshida et al.
6,851,838 B2 2/2005 Haddad et al.
6,905,222 B1 6/2005 Russello et al.
RE38,767 E 8/2005 Wedell et al.
7,090,382 B2 8/2006 Haddad et al.
7,150,542 B1 12/2006 Russello et al.
7,151,684 B2 12/2006 Matsunaga et al.
7,325,938 B2 2/2008 Yoshida et al.

* cited by examiner

ADAPTER ASSEMBLY FOR POLE LUMINAIRE

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Invention

The present invention pertains to pole mounted luminaires. More particularly, the present invention pertains to an adapter for mounting a luminaire arm to a pole.

2. Description of the Related Art

Pole lights come in various forms, and typically include a pole and a mounting arm which is mounted to the pole near an upper portion of the pole length, and further includes a luminaire disposed at an end of the arm distal from the pole. The pole luminaire may include a single arm or a double arm with two opposed luminaires. The arms are typically four to ten feet in length and may be round, tapered or elliptical. In general, the pole and arm must support the weight of the luminaire and be properly engineered for wind loading. The means for mounting the arms to the poles come in various forms. In a pole top installation, the arm structure may be mounted within the inner diameter of the pole at an upper end. Alternatively, in a side mount installation, a bracket may be mounted to the outside circumference of the pole attached by bolts. In yet a further alternative, a hub may be utilized which slips over the upper end of the pole or tenon and may be held in place with set screws. In this type of installation, the arm may be oriented in any direction desired at the time of installation. With hub mounted luminaire arms, problems are sometime associated with the setscrews which are not resistant enough to prevent rotation of the hub in high wind conditions. Also a pre-drilled hole is required on the lighting pole for routing the electrical wiring. Similarly, an arm may be mounted using a clamp-on bracket, which clamps about the outer circumference of the upper end of the pole or tenon. With clamp-on brackets, problems often occur with complex installations due to the many components and fasteners. Also a pre-drilled hole is required on the lighting pole for electrical wiring coming from the bracket. With bolt-on brackets, pre-drilled holes are required on the lighting pole. For lighting pole with thin walls, it may also be necessary to install a threaded insert. Similarly, as previously described, a pre-drilled hole is required on the lighting pole for routing of electrical wiring between the pole and the bracket.

It is preferable to provide a pole luminaire with an adapter assembly for mounting which overcomes these deficiencies.

SUMMARY OF THE INVENTION

A pole adapter assembly for a pole luminaire comprises an adapter body having an upper end, a lower end and an aperture for receiving a pole at the lower end, one of a raised area or a recessed area located on the body between the upper end and the lower end, a multi-point contact area along one plane of the body beneath the one of a raised area or recessed area having a first rib opposite a first set fastener, a second rib opposite a second set fastener and spaced from the first rib and the first set fastener, and at least one fastener and opposed nut disposed between the first and second ribs and the first and second set fasteners. The assembly wherein the body has a recess for receiving a head of the fastener. The assembly wherein the body has a recess for receiving the nut connected to the fastener. The assembly further comprising a second multi-contact area along a second plane of the body, spaced from the first plane. The assembly wherein the second multi-contact area having a third rib opposite a third set fastener, a fourth rib opposite a fourth set fastener spaced from the third rib and the third set fastener, and at least one fastener and an opposed nut disposed between the third and fourth ribs and the third and fourth set fasteners. The assembly wherein the first rib extends radially inward from an inner surface of the body. The assembly wherein the first rib and the first set fastener are spaced apart about 180 degrees. The assembly wherein the body has a shoulder formed on an inner surface of the adapter body against which a pole may be seated. The assembly wherein the adapter body has a circular cross-section. The assembly wherein the upper end of the adapter body has a cap located thereon. The assembly further comprising a band defining the one plane.

A pole adapter for a pole luminaire comprises a body having a preselected geometric shape and a length, the body having an upper end and a lower end, the lower end defining an opening and the body being hollow in part, the body having a single-plane multi-point contact area positioned on the length wherein a first rib is opposite a first set fastener for engaging a pole, a second rib is opposite a second set fastener for engaging the pole, and a bolt extends across the body, one of a recessed area or a raised area for seating a pole arm. The pole adapter wherein said body has a band at the multi-point contact area. The pole adapter wherein the band having a recessed area for receiving a bolt head of the bolt. The pole adapter wherein the first and second ribs extending inwardly from an inner surface of the body. The pole adapter further comprising a second single plane multi-point contact area. The pole adapter wherein the second single plane multi-point contact area is spaced from said first single plane multi-contact area. The pole adapter further comprising a second one of raised seat or recessed seat area. The pole adapter further comprising a mounting plate for positioning over the one of a recessed area or raised area.

A pole adapter assembly comprises a body of preselected geometry having a length between an upper end and a lower end, the body having a substantially hollow at least lower end, a multi-point contact area adjacent the substantially hollow area, the multi-point contact area having at least five points of contact with a pole inserted in the substantially hollow lower end of the body, a mounting plate area which is either a raised surface or a recessed surface, a mounting plate for positioning in the mounting plate area, the mounting plate having an aperture for receiving an arm. The pole adapter assembly wherein the mounting plate area has at least one of a detail and a notch. The pole adapter assembly as set forth in the claims, wherein said mounting plate having at least the other of said detail and said notch.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

DETAILED DESCRIPTION

Figure 1:
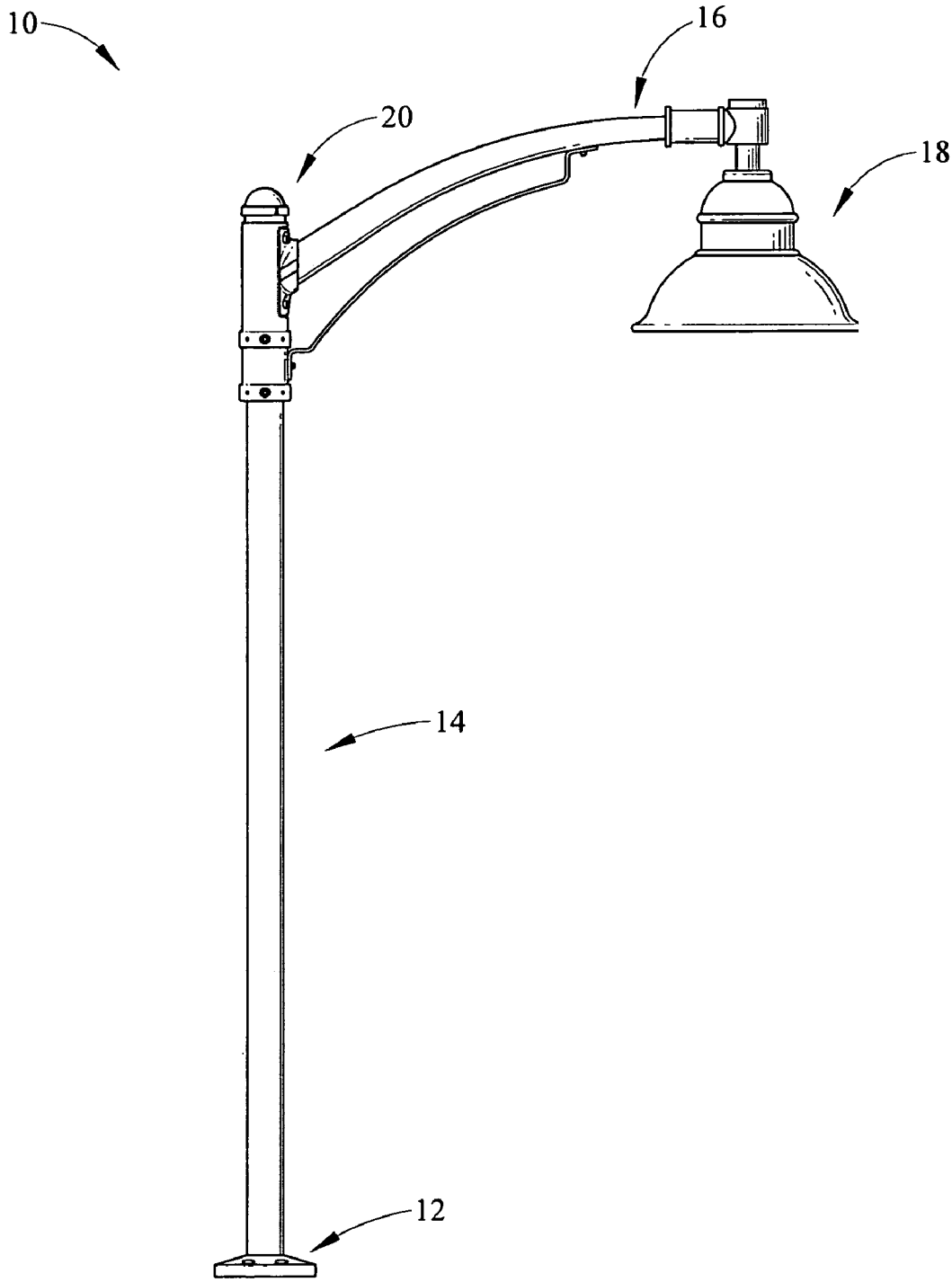
FIG. 1 is a side view of a pole luminaire.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Furthermore, and as described in subsequent paragraphs, the specific mechanical configurations illustrated in the drawings are intended to exemplify embodiments of the invention and that other alternative mechanical configurations are possible.

Referring now in detail to the drawings, wherein like numerals indicate like elements throughout the several views, there are shown in FIGS. 1-13 various aspects of an adapter assembly for a pole luminaire.

Referring initially to FIG. 1, a pole luminaire 10 is depicted in side elevation view. The pole luminaire 10 comprises a base 12, which is connected to a vertically extending pole 14. The base 12 may be formed of steel, aluminum or other sub-rigid materials for connection to a bolt pattern in a substrate. The base 12 may be connected by weld, fasteners or integrally with pole 14. The pole 14 in the exemplary embodiment is circular in cross-section, however the pole 14 may alternatively be square shaped or some other structural desirable and aesthetically pleasing shape. The pole 14 may be formed of steel, aluminum, composite materials, any rigid material or a combination thereof. At an upper portion of the pole 14 is an adapter assembly 20. The adapter assembly 20 is slidably positioned on the upper end of the pole 14, and includes an arm 16 extending there from. At an end of the arm 16 distal from the adapter assembly 20 is a fixture 18, which depends downwardly from the end of arm 16 and includes a lamp for illuminating a preselected area. The adapter assembly 20 may be formed of various materials as previously described however, it may be desirable to form the adapter 20 from the same material as pole 14 to avoid problems between dissimilar metals.

Figure 2:
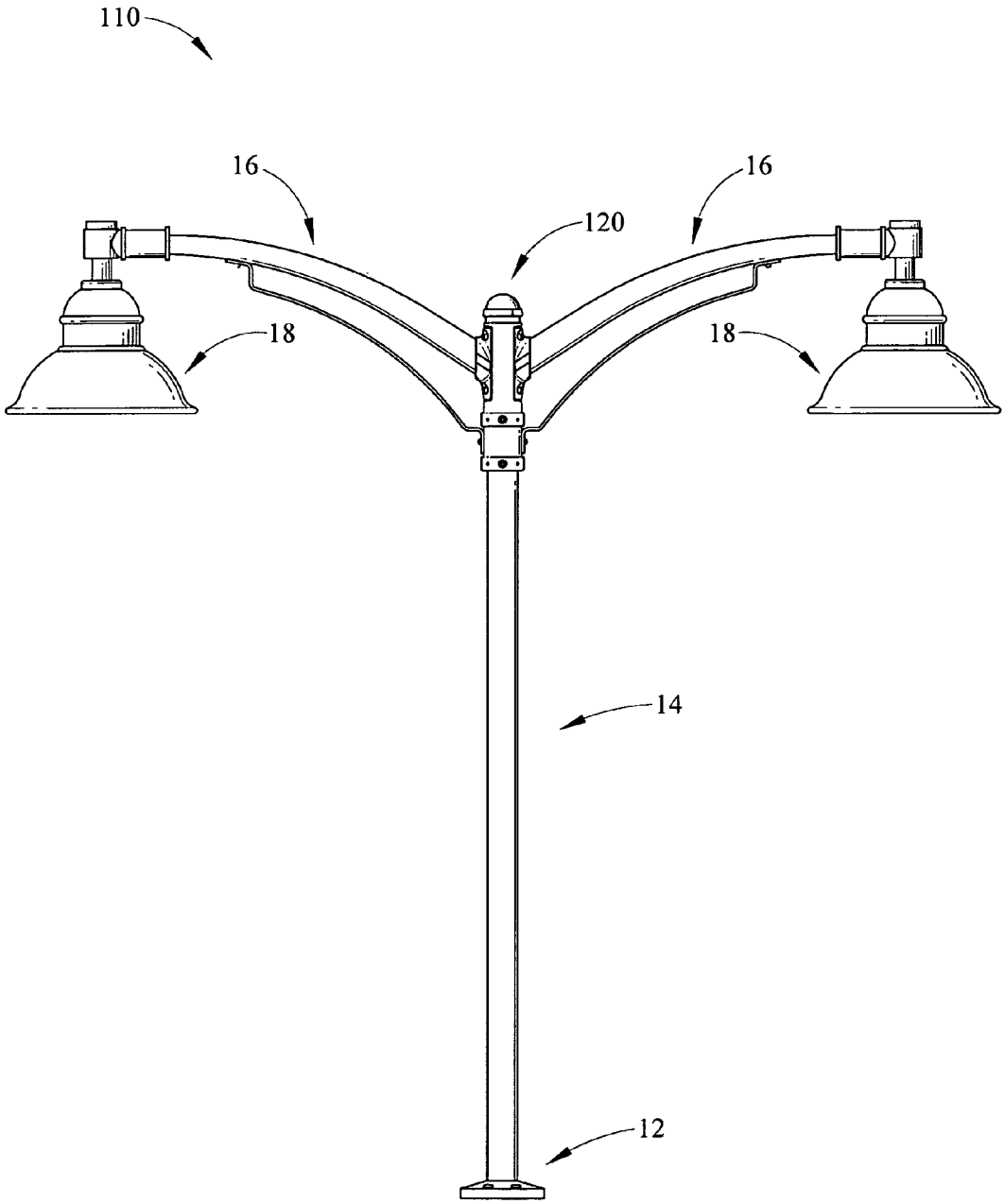
FIG. 2 is a side view of an alternative pole luminaire having dual arms.

Referring now to FIG. 2, an alternative pole luminaire 110 is depicted. The luminaire comprises the base 12, and the pole 14 as with the previous embodiment. At the upper end of the pole 14 is an adapter assembly 120. The adapter assembly 120 allows for connection of two arms 16, rather than a single arm as with the previous embodiment. The arms 16 may be positioned at various angles relative to one another depending upon the area needing illumination. In the exemplary embodiment, the arms 16 are positioned about 180 degrees from one another. However, such angular positioning should not be considered limiting as various angles may be utilized. At ends of each oppositely positioned arm 16 are fixtures 18. Each of the fixtures 18 include a lamp and electronics for illumination of the lamp.

Figure 3:
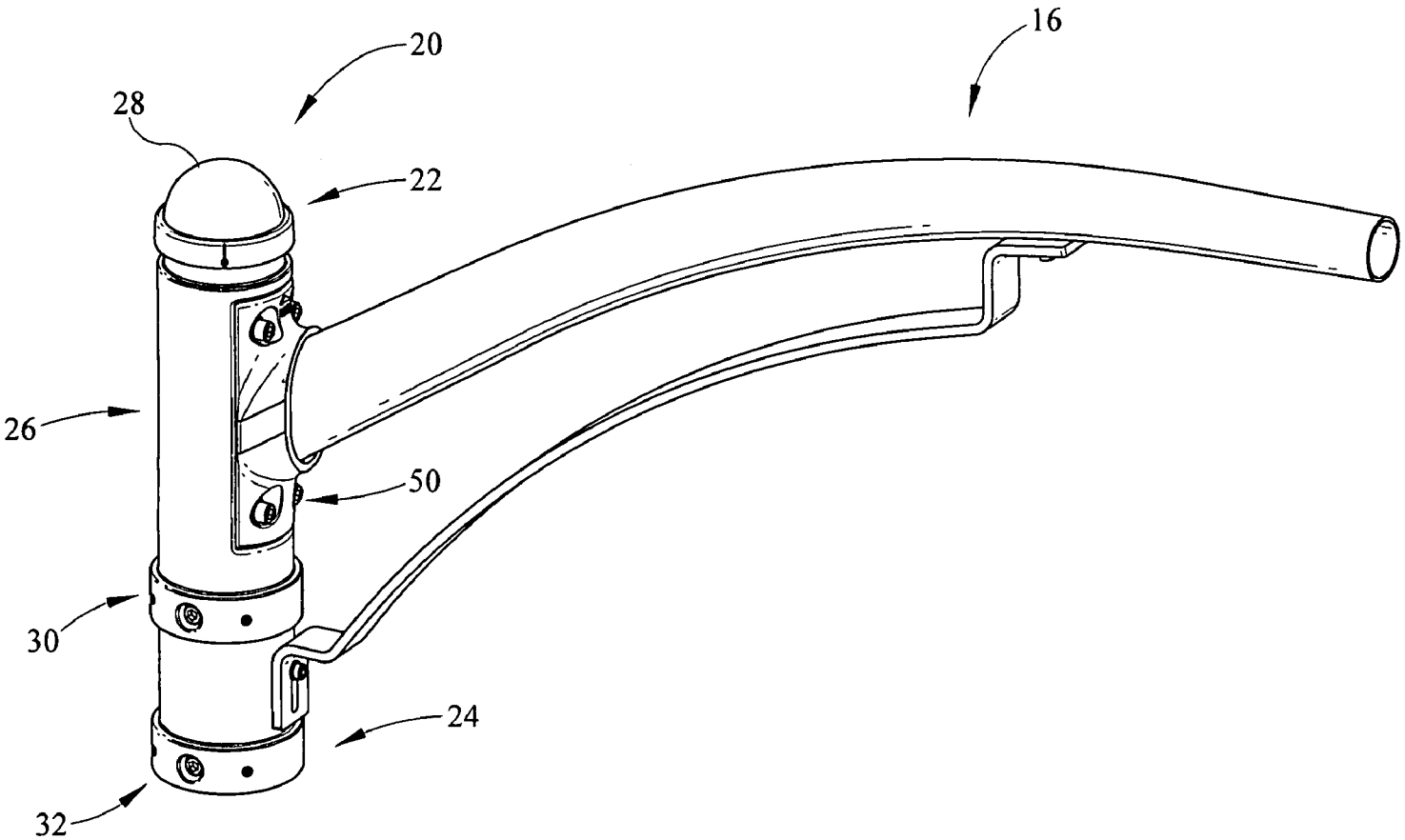
FIG. 3 is a perspective view of an adapter assembly of the pole luminaire.
Figure 13:
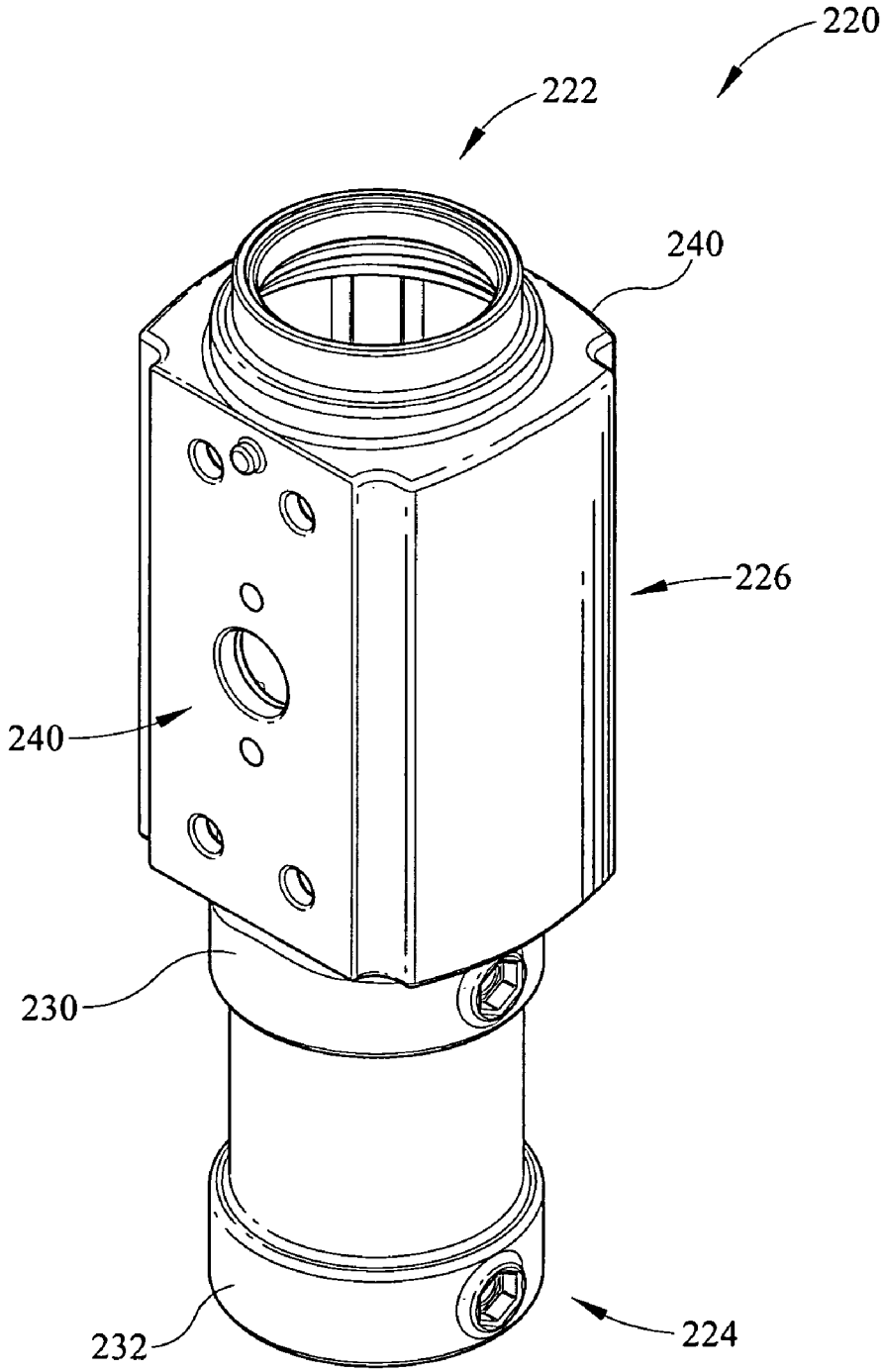
FIG. 13 is an alternative body portion of an adapter assembly.

Referring now to FIG. 3, a close-up perspective view of the adapter assembly 20 is depicted. The adapter assembly 20 has an upper end 22 and a lower end 24. Extending between the upper end 22 and the lower end 24 is a body 26, which is generally cylindrical in shape. Alternatively however, the body 26 may have a cross-section of an alternative shape, such as square, as shown in FIG. 13. At the upper end 22 of the adapter 20 is a cap 28. The cap 28 of the present embodiment is substantially hemispherical in shape. Similarly, alternative designs may be utilized which are aesthetically pleasing pyramidal shapes or finial designs. The cap 28 is fastened to the adapter body 26 by a set screw, although alternative means of connection may be utilized.

Near the lower end 24 of the adapter 20 are first and second bands 30, 32. The upper band 30 and the lower band 32 may be integrally formed with the body 26. The band 30, 32 provide locations wherein fastening devices may be positioned. Between the upper end 22 and the upper band 30 is a mounting plate 50. The mounting plate 50 is utilized as a connecting structure between the body 26 and the arm 16. The mounting plate 50 is a generally rectangular shape and includes a flat rear surface and curved front surface, which is curved to match the curvature of the body 26.

Figure 4:
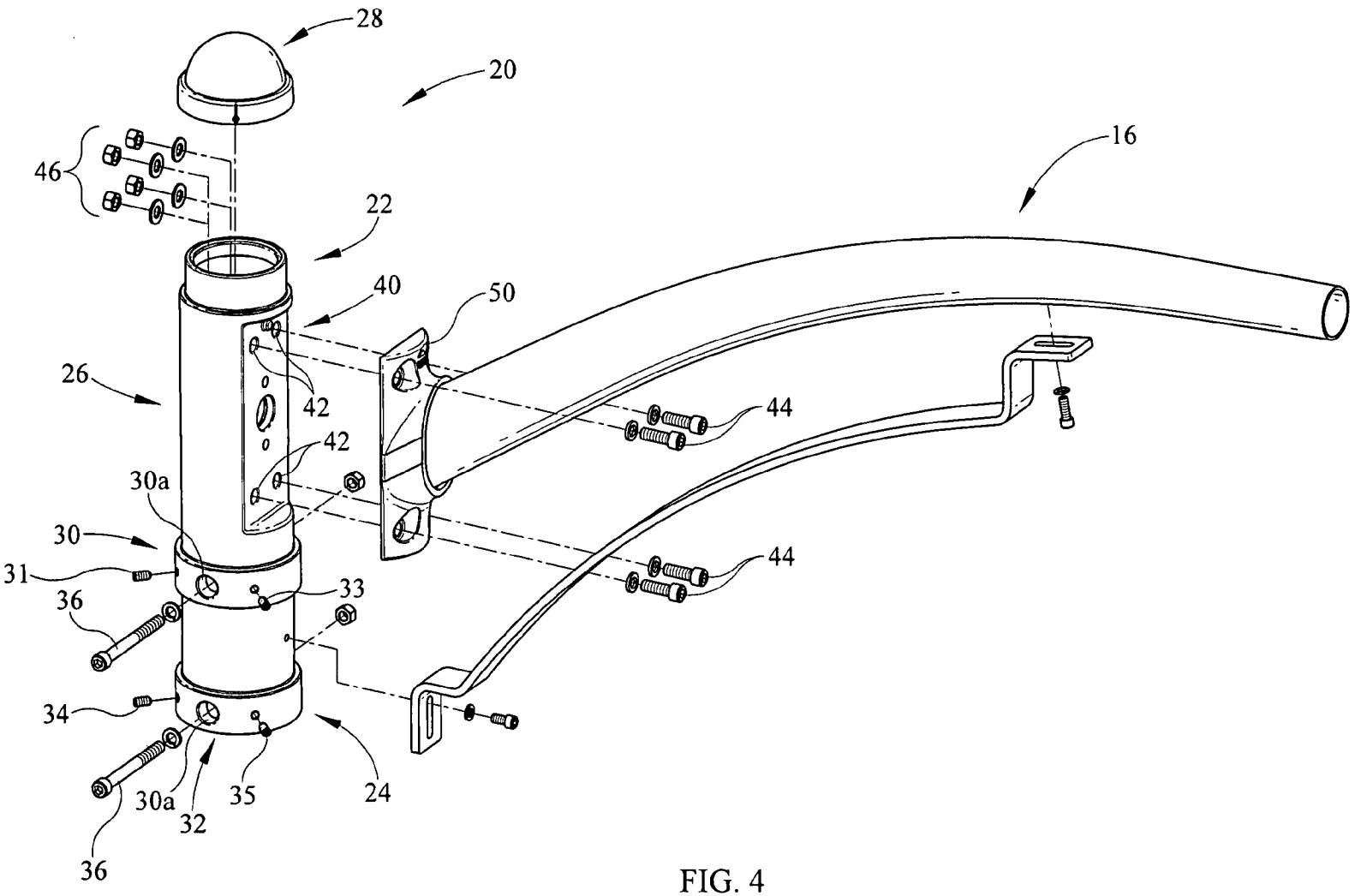
FIG. 4 is an exploded perspective view of the adapter assembly of the pole luminaire.

Referring now to FIG. 4, the adapter assembly 20 is depicted in exploded perspective view. The body 26 comprises a plate mounting area 40. The adapter plate 50 is positioned in the plate mounting area 40, and the front rounded surface of the adapter plate 50 matches the curvature of the body 26 as depicted in FIG. 3, which provides an aesthetically pleasing design.

With the cap 28 removed, a plurality of fasteners are shown with alignment lines moving downwardly into the body 26 for positioning adjacent apertures 42 located on the mounting plate area 40. A plurality of corresponding fasteners 44 are aligned with the fasteners apertures 42 and nuts 46. The fasteners 44 also extend through apertures 52 in the adapter plate 50 and through the aperture 42 in the plate mount area 40.

Referring still to FIG. 4, within the upper band 30 are first and second set screws 31, 33. The sets screws 31, 33 extend through the band 30, and are tightened so as to bear against the pole 14 (FIG. 1). Similarly, the lower band 32 comprises first and second set screws 34, 35. The first and second set screws 31, 33 and 34, 35 are spaced apart about 90 degrees from one another. Also positioned within each band 30, 32 are bolt apertures 30*a*. The bolt apertures 30*a* provide a recessed area wherein a bolt 36 can pass through and the head may be seated. Similarly, the opposite sides of the band 30, 32 comprise apertures 30*b* for receiving nuts wherein bolts 36 may be received for tightening.

Figure 5:
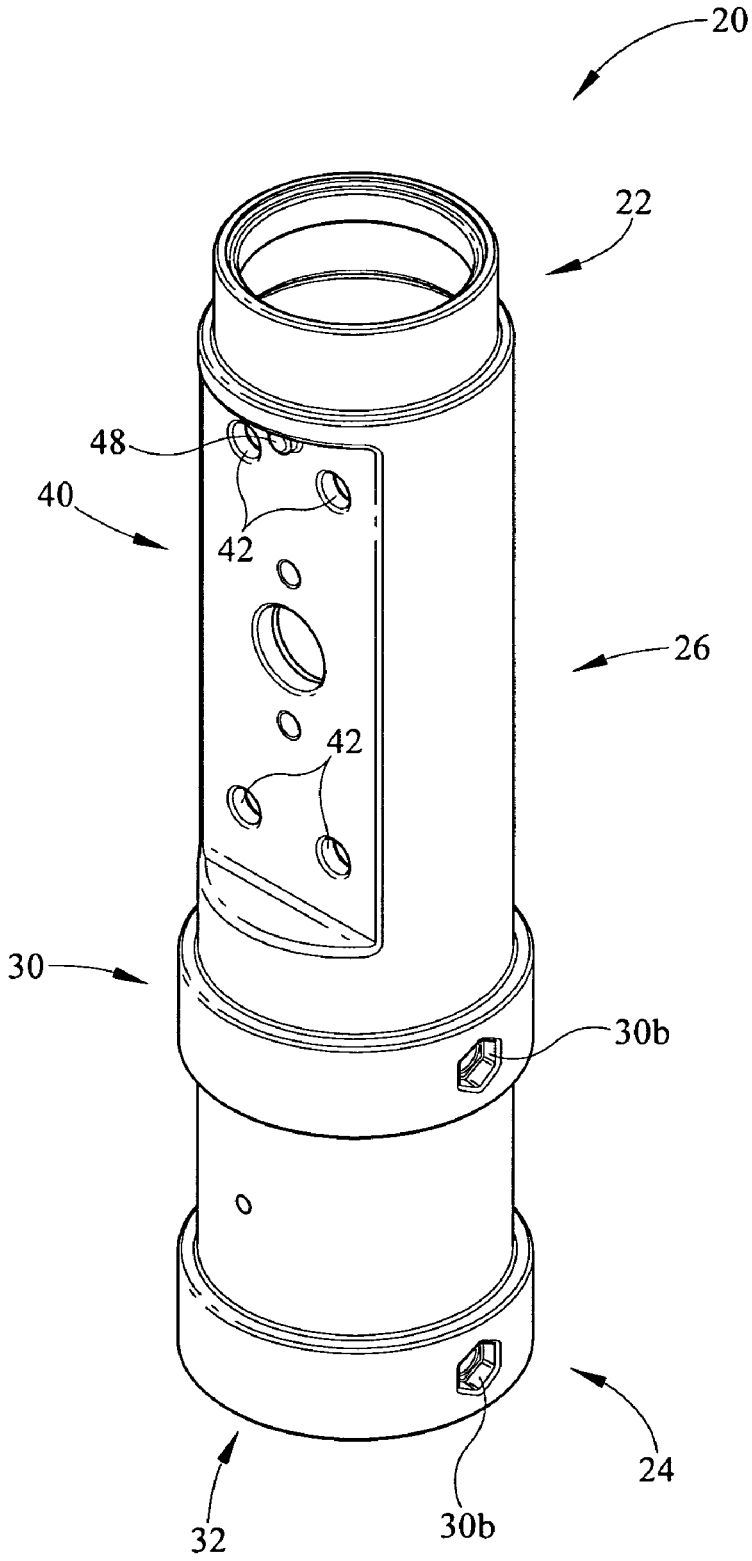
FIG. 5 is a perspective view of a body portion of the adapter assembly of FIG. 5.

Referring now to FIG. 5, an alternative adapter assembly 20 is depicted in perspective view. The adapter body 26 is depicted rotated about 90 degrees from the position in FIGS. 3 and 4. The recess 30*b* is shown for receiving a nut (not shown), which receives the bolt 36. The plate mounting area 40 is also depicted having a flat surface and arcuate upper and lower edges. Within the flat surface are bolt apertures 42 used to fasten the bolts 44 (FIG. 4).

Figure 6:
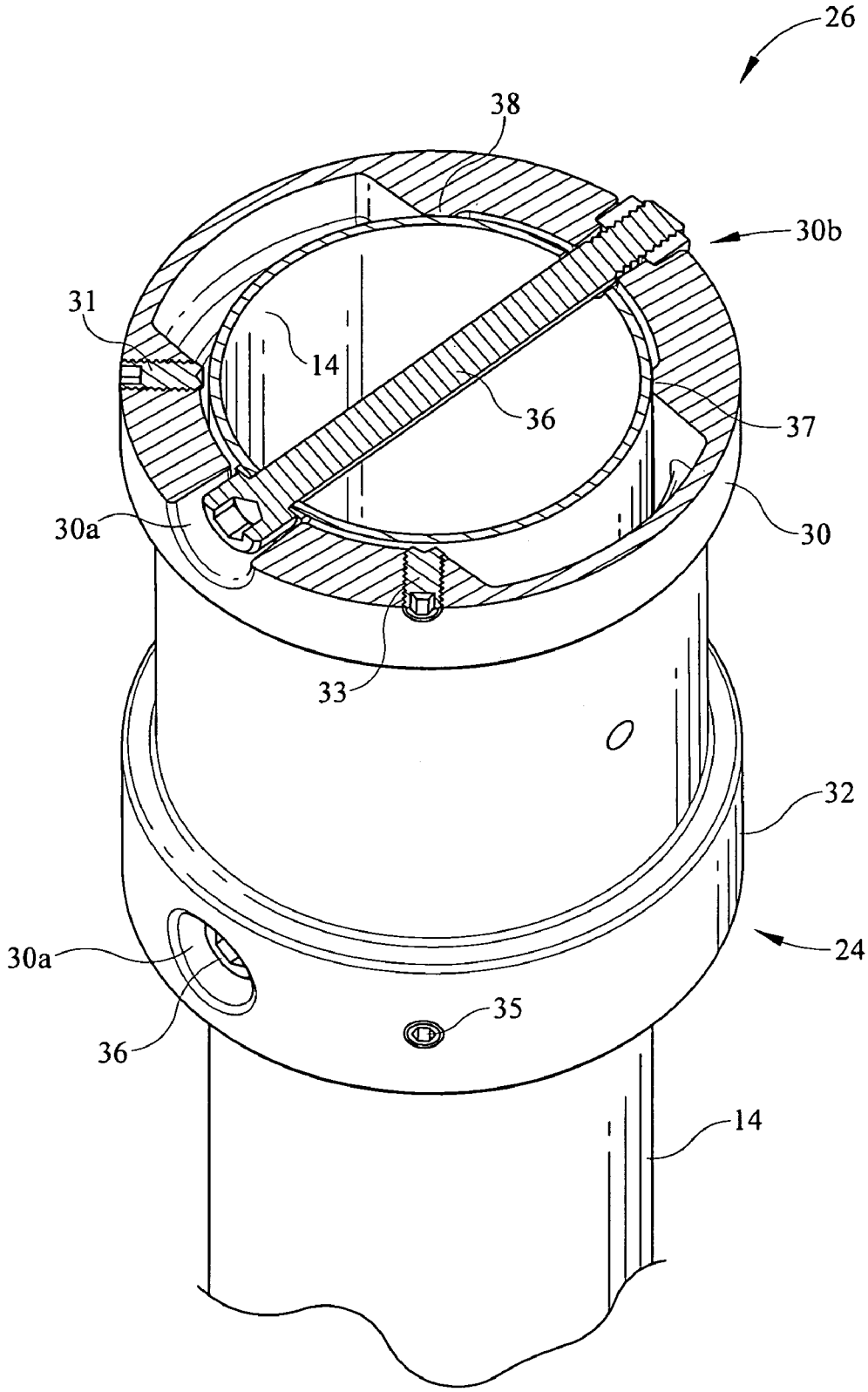
FIG. 6 is a perspective view of a body portion the adapter assembly with a section cut depicting the fastening components.

Referring now to FIG. 6, an adapter body 26 is depicted cut through in a horizontal plane at an upper band 30. Although the embodiment depicted shows the body 26, the alternate body 126 is substantially similar to body 26 in this area of the adapter 20. With the body 26 sectioned through an upper band, the connection between the body 26 and the pole 14 is depicted. The present adapter assembly utilizes at least a five point contact system at each of two horizontal planes of the device. The section through the upper band 30 depicts the first set screw 31 and the second set screw which are spaced apart about 90 degrees. Opposite the first set screw is a first rib 37. As the first set screw 31 is tightened, the first rib 37 engages the pole 14 until the set screw 31 is fully tightened, and the rib 37 and first set screw 31 are both bearing against the pole 14. Similarly, the second set screw 33 is tightened so that the second rib 38 is pulled against the pole 14, and until the second set screw and rib 38 are both bearing against the pole 14. This provides four points of contact. As shown in the drawing, the upper band 30 has first and second threaded segments, which receive the first and second set screws 31, 33. This allows tightening of the set screws 31, 33 with the use of a tool such as an allen wrench, screw driver, socket driver or the like. The bolt 36 is utilized to connect the body 26 to the pole 14. The upper band 30 comprises first and second apertures 30*a* for receiving the bolt 36. The pole 14 also includes first and second apertures which are oppositely positioned, so that the apertures 30*a* can be aligned with the pole apertures and the bolt 36 may be inserted through the pole 14 and adapter body 26 elements. This inhibits rotation of the adapter assembly 20 and body 26 about the pole 14, which may occur due to wind loading for example. The aperture 30*a* receives the bolt head and the aperture 30*b* receives and retains a nut, which receives a threaded end of the bolt 36. Such assembly provides at least one additional point of contact between the body 26 and pole 14 and therefore the adapter assembly 20 has at least a five point contact system. Pockets may be formed in the body 26 within the bands 30,32 in order to reduce weight and cost of the component 26.

Figure 7:
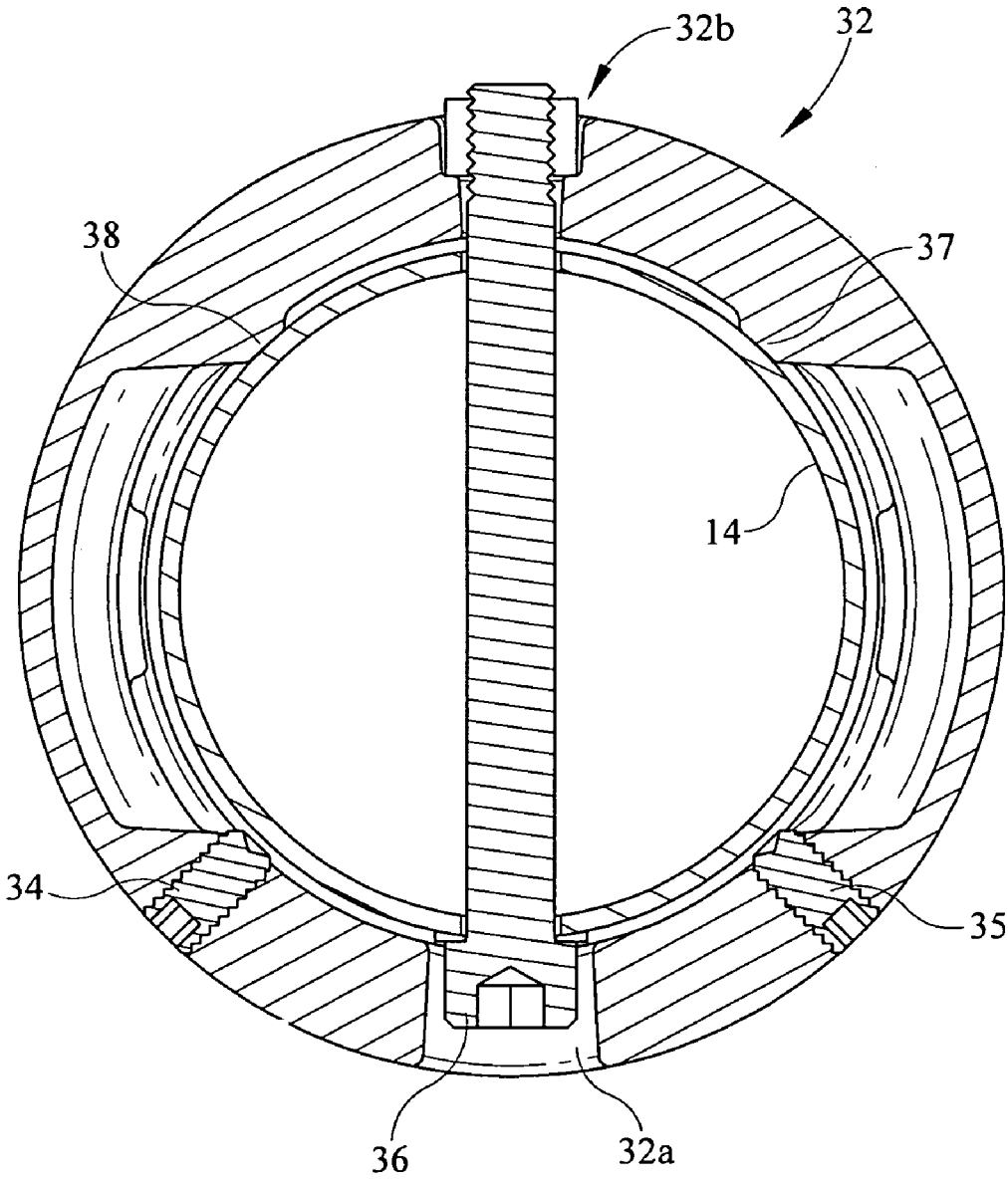
FIG. 7 is a sectioned view of the body portion of the adapter assembly.

Referring now to FIG. 7, a top-section view of the lower band 32 is depicted. The lower band 32 utilizes the at least five point contact system as well by including ribs along the internal surface of the body 26 and oppositely positioned set screws with a bolt 36 to all engage the pole 14 and body 26. The lower band also includes the at least five point contact system wherein first and second set screws 34, 35 are oppositely positioned from ribs 37, 38. The bolt 36 also extends through the aperture 30*a* and aperture 30*b*, as well as through the pole 14 with apertures that are aligned with the apertures 32*a*, 32*b* of the lower band 32.

Figure 8:
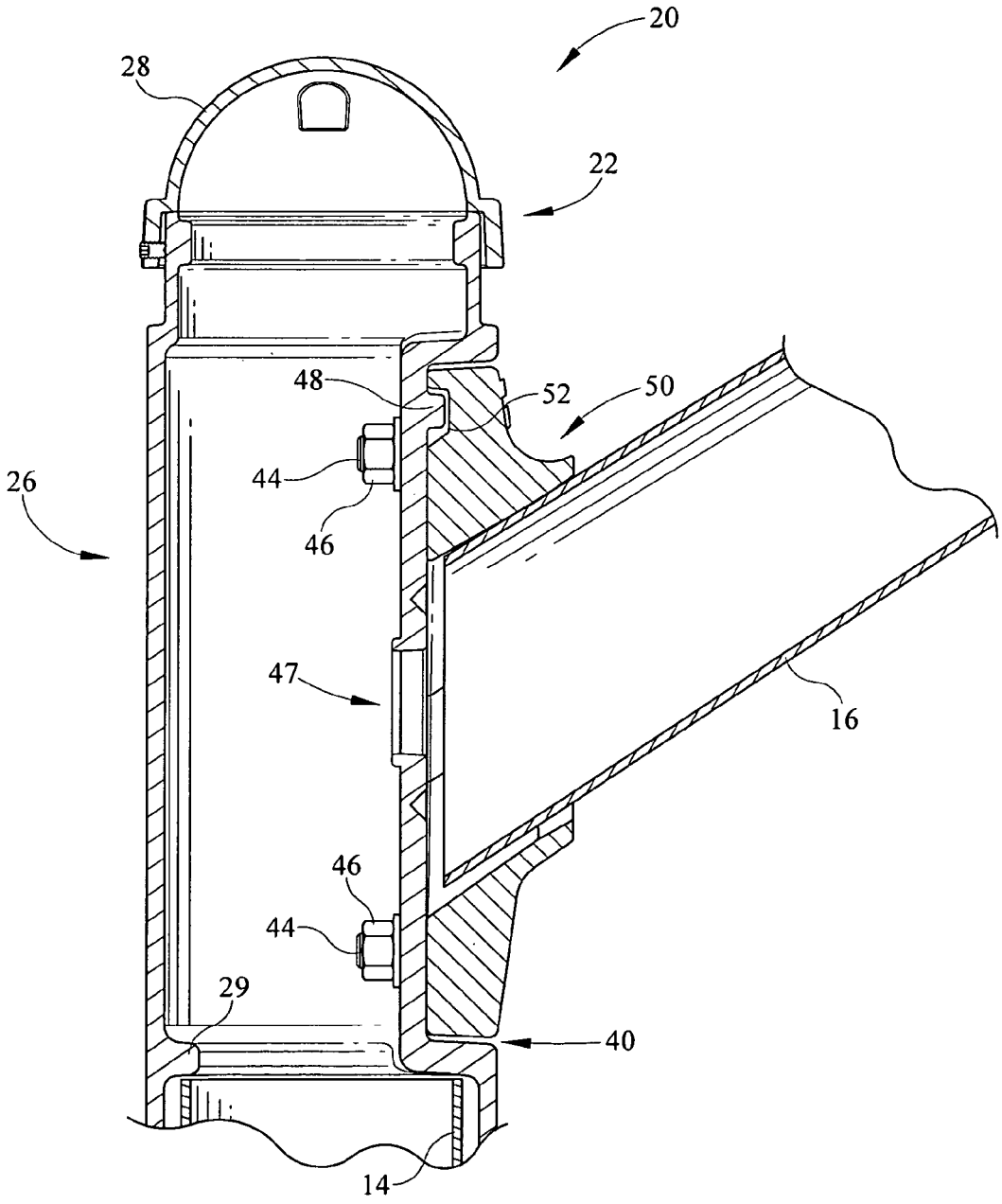
FIG. 8 is a side section view of the adapter assembly of FIG. 3 depicting an exemplary adapter plate.

Referring now to FIG. 8, a side-sectional view of the adapter assembly 20 is depicted. As previously described, the adapter assembly 20 comprises a body 26 having an upper end 22 and a lower end which receives a pole 14. Near the lower end is a shoulder 29 extending along the interior circumference of the body 26 against which the pole 14 is seated. Along a portion of the body 26 is the plate mounting area 40 which is defined generally by a vertical planar cut from the calm area of the body between the upper end 22 and the upper band 30. The plate mounting area 40 receives the adapter plate 50 as previously described. In the sectional view depicted, a mounting detail 48 is located on the plate mounting area for alignment with a notch 52 on the adapter plate 50. The detail 48 receives the notch 52, so that the adapter plate 50 is aligned properly in the mounting plate area 40, and so that apertures 42 of the mounting plate area 40 are aligned with apertures 56 in the adapter plate 50, so as to receive the fasteners 44. The detail 48 also inhibits improper positioning of the adapter plate 50 within the plate mounting area 40 during the installation. The detail 48 and notch 52 may be various shapes wherein the detail fits into the notch. Also, it should be understood to be well within the scope of the present invention that the positions of the notch and detail may be reversed relative to the body 26 and plate 50.

The sectional view also depicts a wireway opening 47 through which wire may pass from the pole 14 through the adapter assembly 20, through the arm 16 and to the fixture 18 for powering the lamp electronics, as well as the lamp therein. The electrical/control wiring is routed upwardly through the upper end of the pole 14, and through wireway opening 47 to the fixture 18. This eliminates the need to drill a wire opening in the pole 14.

Figure 9:
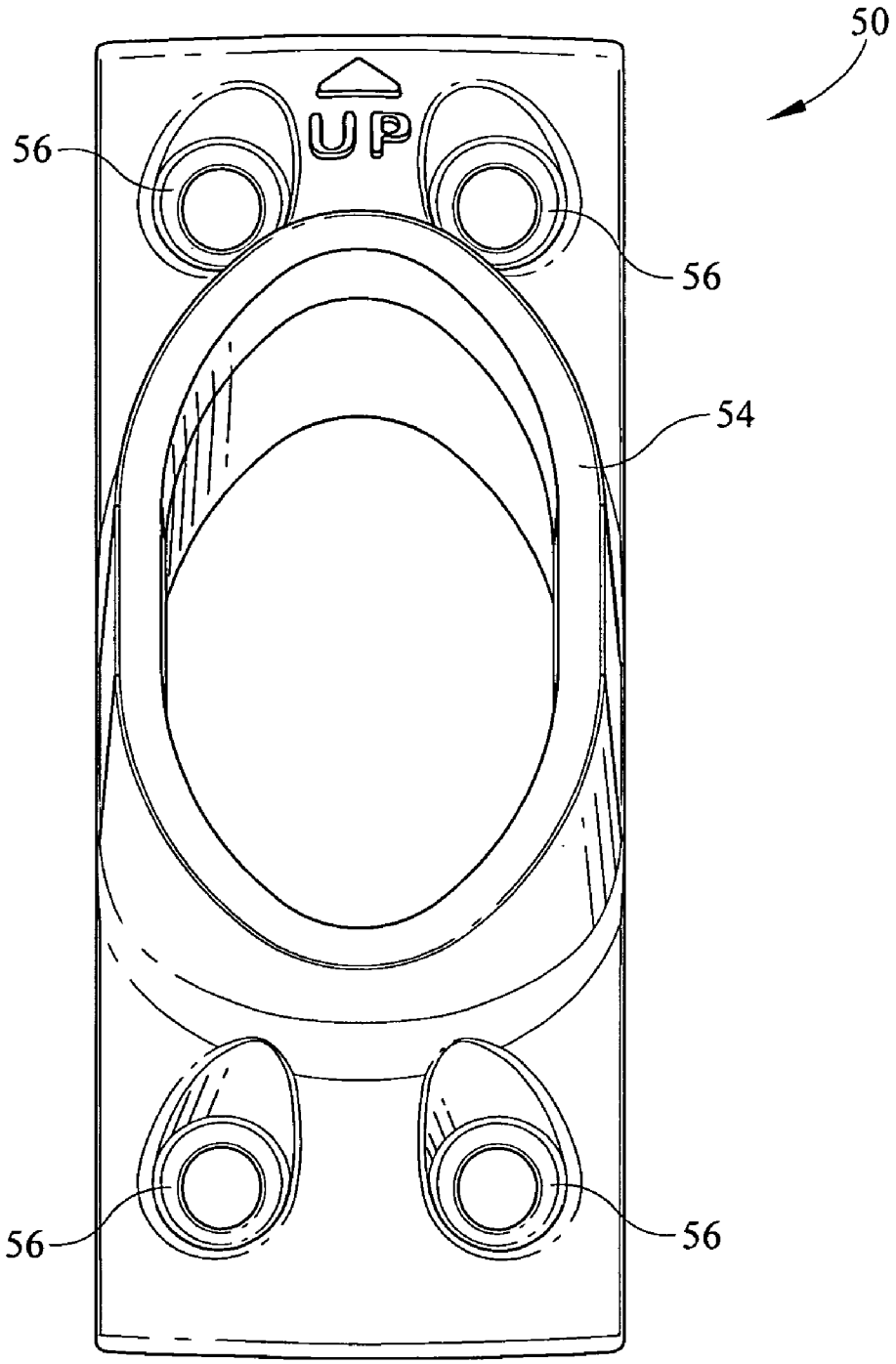
FIG. 9 is a front elevation view of the exemplary adapter plate.

Referring now to FIG. 9, the adapter plate 50 is shown in a front elevation view. The adapter plate comprises a centrally positioned arm mount 54. The arm mount aperture 54 is angled upwardly, and therefore substantially elongated to direct the arm 16 (FIG. 9) at an upward angle. The adapter plate 50 further comprises four bolt apertures 56 which are formed to receive the bolts 44. The arm aperture 54 may be arranged to position the arm 16 at a plurality of angles relative to the horizontal. In the exemplary embodiment, the angle of the opening is about 33 degrees, however the angles may range from about 0 degrees to about 50 degrees.

Figure 10:
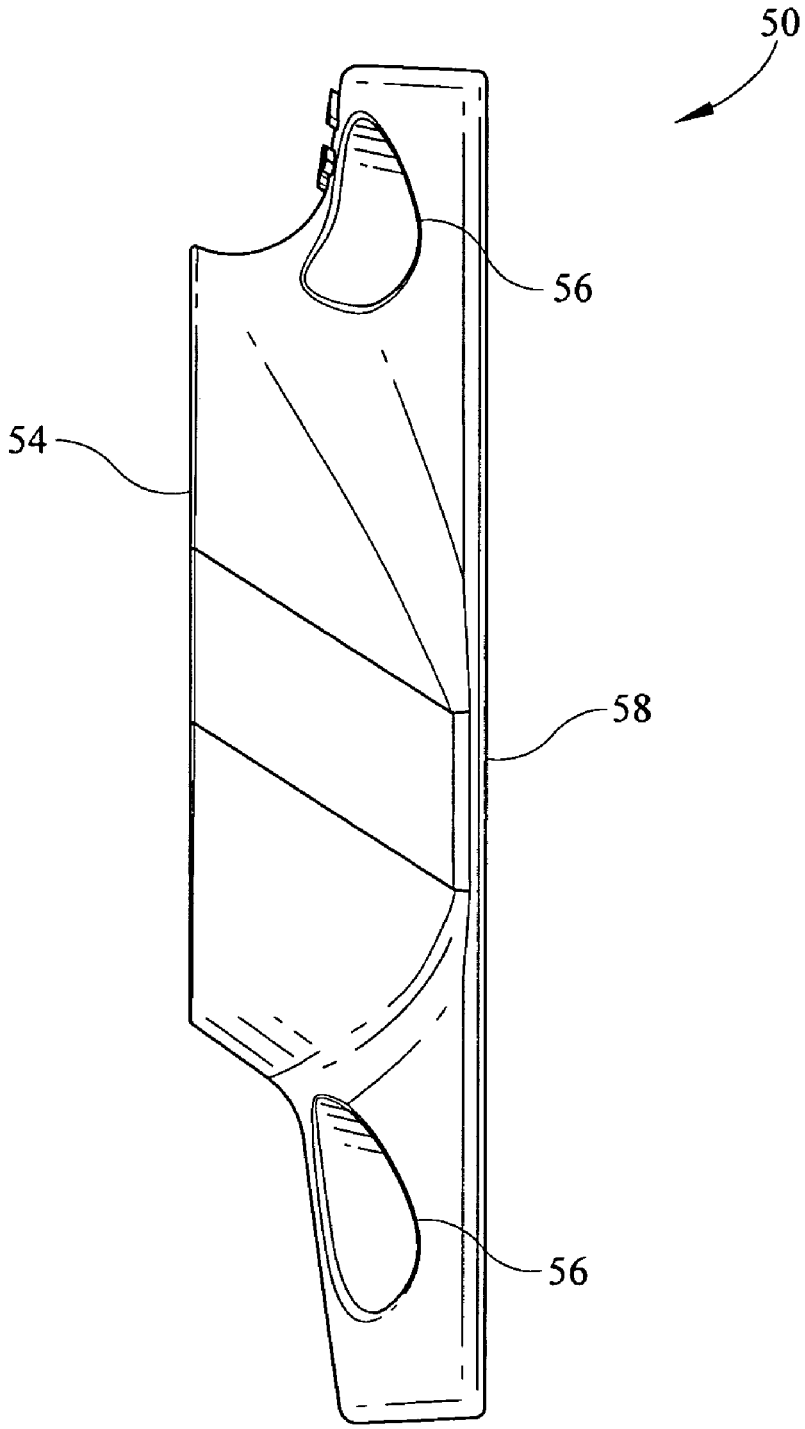
FIG. 10 is a side elevation view of the exemplary adapter plate.

Referring to FIG. 10, a side elevation view of the adapter plate 50 is depicted. In this view, the front surface may be seen as rounded. The curvature matches that of the adapter body 26. Additionally, the rear surface 58 is shown as flat or straight which abuts the flat surface of the plate mounting area 40.

Figure 11:
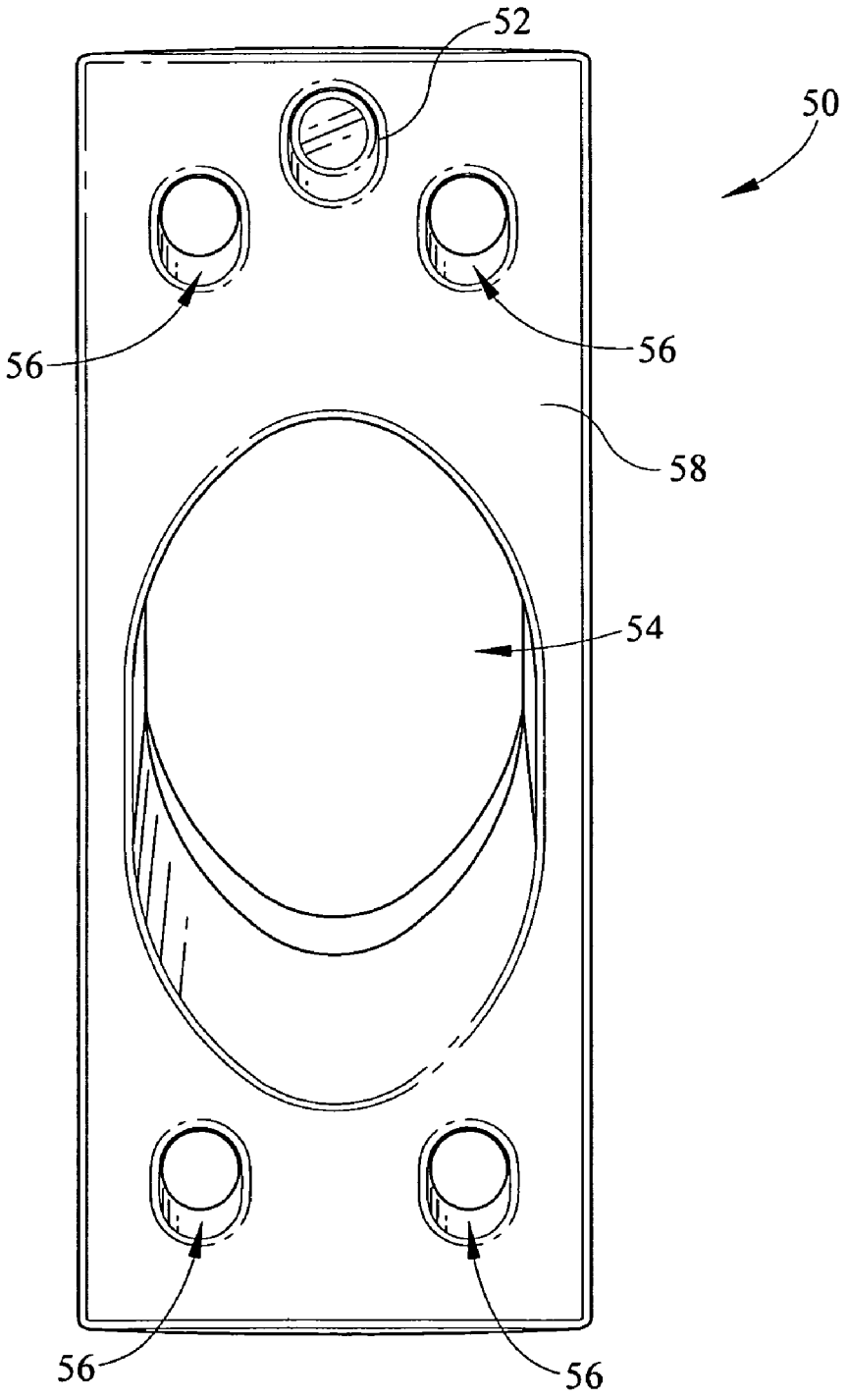
FIG. 11 is a rear elevation view of the exemplary adapter plate.

Referring now to FIG. 11, the adapter plate 50 is shown in a rear elevation view. The notch 52 is clearly shown for receiving the detail 46 (FIG. 8). The four bolt or fastening apertures 56 are also shown. Additionally, and with reference to FIG. 11, the rear surface 58 of the adapter plate 50 is shown to be flat, so as to correspond with the flat vertical surface of the body 20 in the plate mounting area 40. However, as shown in FIGS. 10 and 11, the front surface of the adapter plate 50 is substantially rounded matching the curvature of the body 26 (FIG. 3).

Figure 12:
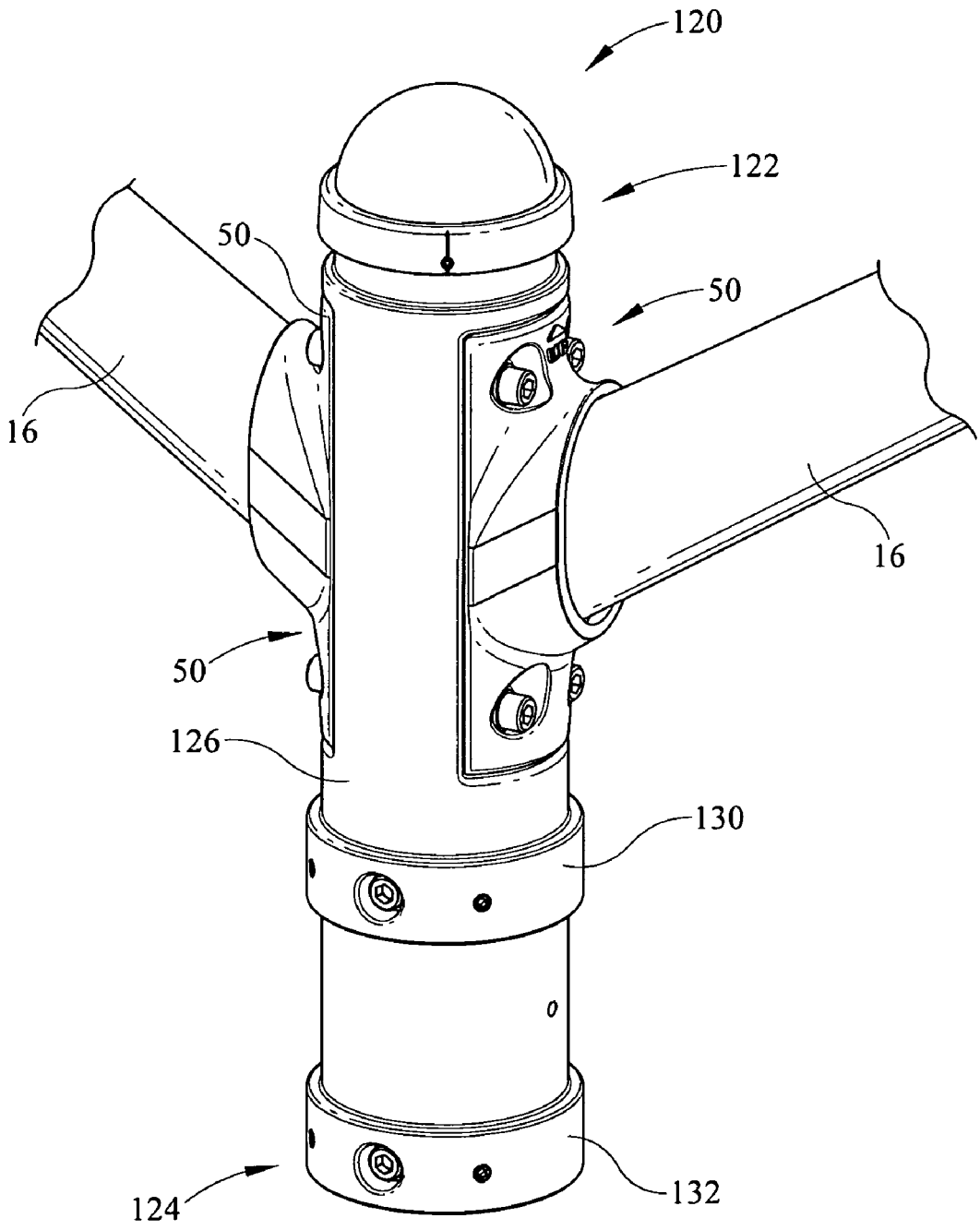
FIG. 12 is a perspective view of the adapter assembly of FIG. 2.

Referring now to FIG. 12, an adapter assembly 120 is depicted in perspective view. The adapter assembly 120 is an alternative embodiment wherein two arms 16 may be attached to a single adapter. The adapter assembly 120 comprises an upper end 122, a lower end 124, and a body 126 positioned between the ends. The body comprises two plate mounting areas where adapter plates 50 are positioned. An arm 16 extends from each of the adapter plates, so that the arms are spaced apart on the circumference of the body 126.

In the exemplary embodiment, the adapter assembly is configured to space the arms apart at about 180 degrees from one anther, however alternative angular spacings may be utilized with the instant embodiments. The body 126 further comprises an upper band 130 and a lower band 132, as described in the previous embodiment.

Referring now to FIG. 13, an alternative adapter assembly 220 is depicted. The adapter assembly 220 is depicted having a body 226 with flat surfaces to which the adapter plates 50 are mounted. The body 226 has an upper end 222 and a lower end 224. The lower portion of the body 226 has a round cross-section for receiving the pole 14 as previously described. However, above the upper band 230 and lower band 232 the body 226 has a decorative alternative cross-sectional shape. On two sides of the body 226 a flat surface, or plate mounting area 240, is found for positioning of the mounting plates 50. The mounting area 240 is raised, rather then recessed, from the body 226. The alternate adapter assembly 220 provides a further aesthetically pleasing design which utilizes the dual at least five point contact system along with the mounting plate 50 for mounting at least one arm 16 and luminaire 18. The upper portion of the adapter assembly 220 may further comprise a cap, which is not shown in the Figure.

The foregoing description of structures and methods has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. A pole adapter assembly for a pole luminaire, comprising;

an adapter body having an upper end, a lower end and an aperture for receiving a pole at said lower end;

one of a raised area or a recessed area located on said body between said upper end and said lower end;

a multi-point contact area along one plane of said body beneath said one of a raised area or recessed area having a first rib opposite a first set fastener, a second rib opposite a second set fastener and spaced from said first rib and said first set fastener, and at least one fastener and opposed nut disposed between said first and second ribs and said first and second set fasteners;

a second multi-contact area along a second plane of said body, spaced from said first plane;

wherein said second multi-contact area having a third rib opposite a third set fastener, a fourth rib opposite a fourth set fastener spaced from said third rib and said third set fastener, and at least one fastener and an opposed nut disposed between said third and fourth ribs and said third and fourth set fasteners.

2. The assembly of claim 1 further comprising a shoulder formed on an inner surface of said adapter body for contacting said pole when received in said aperture at said lower end.

* * * * *